US009093735B2

(12) United States Patent
Barth

(10) Patent No.: US 9,093,735 B2
(45) Date of Patent: Jul. 28, 2015

(54) DIPLEXER FOR HOMODYNE FMCW-RADAR DEVICE

(75) Inventor: Helmut Barth, Erbach (DE)

(73) Assignee: Endress + Hauser GmbH + Co. KG, Maulburg (DE)

( * ) Notice: Subject to any disclaimer, the term of this patent is extended or adjusted under 35 U.S.C. 154(b) by 89 days.

(21) Appl. No.: 13/995,684

(22) PCT Filed: Dec. 1, 2011

(86) PCT No.: PCT/EP2011/071460

§ 371 (c)(1),
(2), (4) Date: Jun. 19, 2013

(87) PCT Pub. No.: WO2012/084443

PCT Pub. Date: Jun. 28, 2012

(65) Prior Publication Data

US 2013/0271237 A1 Oct. 17, 2013

(30) Foreign Application Priority Data

Dec. 21, 2010 (DE) ..... 10 2010 063 800

(51) Int. Cl.

| | |
|---|---|
| ***H01P 5/12*** | (2006.01) |
| ***H01P 5/22*** | (2006.01) |
| ***H01P 5/18*** | (2006.01) |
| ***H01P 1/213*** | (2006.01) |

(52) U.S. Cl.
CPC ..... *H01P 5/182* (2013.01); *H01P 1/2138* (2013.01)

(58) Field of Classification Search
USPC ..... 333/113, 117, 121, 122
See application file for complete search history.

(56) References Cited

U.S. PATENT DOCUMENTS

| | | | | |
|---|---|---|---|---|
| 2,475,474 | A * | 7/1949 | Bruck et al. | 370/281 |
| 2,587,590 | A * | 3/1952 | Brewer | 455/81 |
| 2,915,216 | A | 12/1959 | Coffman | |
| 3,371,292 | A | 2/1968 | Hammer | |
| 3,999,151 | A | 12/1976 | Baldwin et al. | |
| 4,473,828 | A * | 9/1984 | Morz et al. | 343/786 |
| 4,700,154 | A * | 10/1987 | Schuegraf | 333/125 |
| 5,066,959 | A * | 11/1991 | Huder | 343/786 |
| 6,127,902 | A | 10/2000 | Speldrich et al. | |
| 7,397,323 | B2 * | 7/2008 | Tavassoli Hozouri | 333/117 |
| 7,443,215 | B1 * | 10/2008 | Sidiropoulos | 327/156 |

(Continued)

FOREIGN PATENT DOCUMENTS

| | | | |
|---|---|---|---|
| CN | 101416347 | A | 4/2009 |
| DE | 19716290 | A1 | 10/1998 |

(Continued)

OTHER PUBLICATIONS

Beyer et al., "Compact Top-Wall Hybrid/Coupler Design for Extreme Broad Bandwidth Applications", X-002675748, Microwave Symposium Digest, Jun. 12, 2005, pp. 1227-1230.

(Continued)

*Primary Examiner* — Adam Houston
(74) *Attorney, Agent, or Firm* — Bacon & Thomas, PLLC

(57) ABSTRACT

A diplexer for a homodyne FMCW-radar device, which is distinguished by small dimensions of its hollow conductor structure and therefore can be manufactured simply and cost effectively. The hollow conductor structures of the diplexer can be cut out from two half shells, and the latter joined to form the diplexer. Various materials provide options for the material of the half shells.

9 Claims, 2 Drawing Sheets

(56) References Cited

U.S. PATENT DOCUMENTS

| | | | | |
|---|---|---|---|---|
| 7,457,346 | B2 * | 11/2008 | Fiedler | 375/130 |
| 7,656,214 | B1 * | 2/2010 | Han | 327/291 |
| 7,671,700 | B1 * | 3/2010 | Rosenberg et al. | 333/113 |
| 8,497,809 | B1 * | 7/2013 | Herting et al. | 343/776 |
| 8,736,324 | B2 * | 5/2014 | Wong | 327/156 |
| 2004/0076221 | A1 * | 4/2004 | Refaeli et al. | 375/130 |
| 2005/0221785 | A1 * | 10/2005 | Fiedler | 455/323 |
| 2006/0220947 | A1 | 10/2006 | Kornbichler et al. | |
| 2009/0289742 | A1 * | 11/2009 | Oguma | 333/137 |
| 2010/0060512 | A1 | 3/2010 | Garrod et al. | |
| 2013/0093478 | A1 * | 4/2013 | Wong | 327/156 |

FOREIGN PATENT DOCUMENTS

| | | | |
|---|---|---|---|
| DE | 10314557 | A1 | 10/2004 |
| EP | 0872910 | A2 | 10/1998 |
| GB | 2313714 | A | 12/1997 |
| GB | 2449825 | A | 12/2008 |
| JP | 9119977 | A | 5/1997 |
| JP | 2000101308 | A | 4/2000 |
| JP | 2004312089 | A | 11/2004 |
| JP | 2007136600 | A | 6/2007 |
| JP | 200835187 | A | 2/2008 |

OTHER PUBLICATIONS

German Search Report in corresponding German Application No. 10 2010 063 800.5 dated Dec. 21, 2010.

International Preliminary Examination Report in corresponding International Application No. PCT/EP2011/071460 dated Jul. 4, 2013.

International Search Report in corresponding International Application No. PCT/EP2011/071460 dated May 30, 2012.

* cited by examiner

DIPLEXER FOR HOMODYNE FMCW-RADAR DEVICE

TECHNICAL FIELD

The invention relates to a diplexer for a homodyne FMCW-radar device. The invention relates especially to such a diplexer constructed in hollow conductor technology.

BACKGROUND DISCUSSION

Diplexers serve in radar devices to connect two inputs to one output and act, in this sense, as a frequency gate. Thus two input channels can be decoupled and separated in the signal direction, in order, for example, to be able to operate an antenna connected with one output channel. Echo signals, which are reflected from transmission signals of the antenna striking on reflecting surfaces and received back, can then be distributed back to the associated receiver. On the one hand, signals in the diplexer should be attenuated as little as possible, and, on the other hand, the decoupling between both input channels should be as great as possible. This means that signals should only be led in the desired direction, while, in the other direction, attenuation should be as great as possible.

Known diplexers for radar technology in the low cost field are, for example, arranged as microstrip couplers directly on circuit boards and can therewith be embodied very small, very precisely and very cost effectively, so that they can be used in consumer products, such as, for example, mobile telephones. Their disadvantages include low directional characteristics and high losses at moderate matching.

On the other hand, diplexers are known, whose conductor structure is formed from hollow conductor sections. A hollow conductor structure for a diplexer is composed, in principle, of two virtually parallel extending, hollow conductor channels formed of hollow conductor sections following one another, the power dividers. The hollow conductor sections of a hollow conductor channel are usually separated by a coupling zone. After the first power divider, the two power halves travel different path lengths and obtain, thus, different phases. The second power divider works as a summing element, when the two power halves, in spite of different path lengths, have equal phases. If the phases differ, however, then a weakening of the power occurs. If the phases are opposite, then the power is erased. A effective diplexer must thus be so dimensioned as regards line lengths that on the respective output line in the one frequency a summing occurs and in the other frequency a canceling. A diplexer works most effectively, when the tunable detour line fulfills the following conditions simultaneously:

the phase shift for one frequency must be 0°;

the phase shift for the other frequency must be 180°.

The frequency separation between the two transmission frequencies is predetermined by the diplexer design. Usually, detour lines are dimensioned with a multiple of the wavelength, since then even smaller phase differences are multiplied and the diplexer obtains thereby a narrower passthrough characteristic. Therewith, the transmitting frequencies are predetermined such that the same hollow conductor length must have for the one frequency an exactly even numbered multiple and for the second frequency an odd numbered multiple of the half wavelength. The diplexer becomes, as a result, also transmissive for other frequencies, which are usually suppressed by a supplemental filter. A further reason for the use of a multiple wavelength is that therewith the installed frequency separation between the two transmitting frequencies is lessened.

FMCW-radar devices with a diplexer with a hollow conductor structure are especially suitable for broadband applications, such as, for example, distance measurement and fill level measurement in the context of industrial process measurements technology, since they are distinguished by a high power-handling capability and enable a relatively simple tuning to the desired frequencies.

Known from the publication "Compact Top-Wall Hybrid/Coupler Design for Extreme Broad Bandwidth Applications" by Ralf Beyer and Uwe Rosenberg, Microwave Symposium Digest, MTT-S International 12-17 Jun. 2005, ISBN 0-7803-8846-1/05, pages 1227-1230 is a diplexer of the above described type, which is designed for broadband use and is composed of two half shells. It uses, however, in a coupling zone between the hollow conductor sections a hollow conductor, slit coupler, which, for example, for the frequencies of greater than 50 GHz desired for industrial process measurements technology, must be relatively large, wherein it must, on the other hand, have extremely narrow coupling slits, which are difficult to manufacture.

SUMMARY OF THE INVENTION

An object of the invention, therefore, is to provide a diplexer for a homodyne FMCW radar device, wherein the diplexer, because of smaller dimensions of its hollow conductor structure, can be manufactured simply and cost effectively.

This object is achieved according to the invention by a diplexer for a homodyne FMCW radar, comprising

- two closely adjoining, parallel, hollow conductors having horizontal polarization and terminal, hollow conductor gates;
- a coupling zone in an opening in a partition for connecting the hollow conductor channels; and
- depressions located in the region of the coupling zone and arranged perpendicular to the hollow conductors;
- wherein a ratio of the dimensions of the hollow conductors to the dimensions of the coupling zone and the depressions is so selected that the diplexer displays a broadband behavior and enables propagation of an H20 wave in the coupling zone;
- wherein at each hollow conductor gate transitions to hollow conductors of transmitter and receiver connected to the diplexer are provided, which transitions are so embodied in position and form that they support the desired broadband behavior; and
- wherein the diplexer is manufactured from two symmetric half shells.

In an advantageous form of embodiment of the invention, the hollow conductors of the diplexer have a rectangular cross section.

In an additional form of embodiment of the invention, the depressions are approximately prismatic.

In another form of embodiment of the invention, the depressions are cylindrical.

In yet another form of embodiment of the invention, the diplexer is composed of two half shells, wherein the hollow conductors, depressions and transitions are milled from the half shells.

According to a special embodiment of the invention, it is provided that the milling is done with a tool having a diameter in an order of magnitude of 1 mm.

In the case of further forms of embodiment of the invention, the two half shells, from which the diplexer is assemblable, are injection molded parts, which especially can be plastic injection molded parts.

Again another form of embodiment of the invention provides that the cutting plane of the half shells lies in the plane of the electrical field strength E.

Still another form of embodiment of the invention relates to a fill level measuring device, which includes a diplexer of the invention.

Special advantages of the diplexer of the invention include that

- exactly in the case of very high frequencies, small hollow conductor dimensions result,
- the hollow conductor structure is, consequently, manufacturing friendly
- and can be manufactured with milling technology and cost effectively.

BRIEF DESCRIPTION OF THE DRAWINGS

In the following, the invention will now be more exactly explained and described with reference to examples of embodiments of the invention illustrated in the appended drawing, the figures of which show as follows.

DETAILED DISCUSSION IN CONJUNCTION WITH THE DRAWINGS

Figure 1:
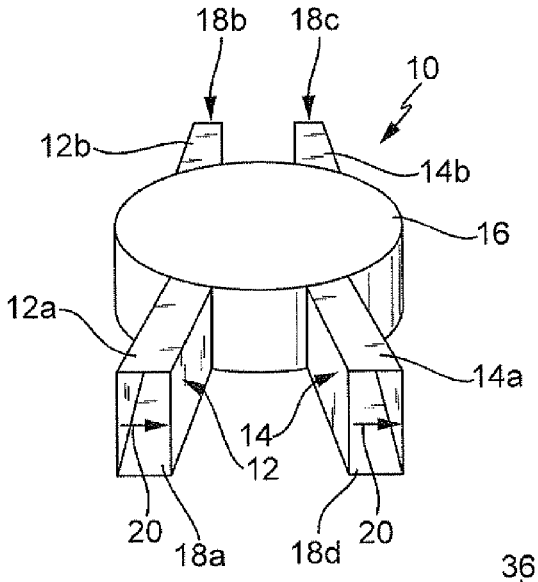
FIG. 1 is a schematic diagram of the principal parts of a diplexer with hollow conductors and coupler in the plane of the electrical field.

For simplification, equal reference characters are used subsequently for equal elements and modules of the diplexer of the invention.

For illustrating the electrical field and as starting point for the diplexer of the invention, FIG. 1 shows a diplexer 1 having two hollow conductor channels 12 and 14, each of which is formed of two hollow conductor sections 12*a*, 12*b* and 14*a*, 14*b*, respectively. The hollow conductor channels 12 and 14, respectively the hollow conductor sections 12*a*, 12*b*, 14*a*, 14*b*, are connected in a hollow conductor coupler 16. Terminally located on the hollow conductor sections 12*a*, 12*b* and 14*a*, 14*b* are a first gate 18*a*, a second gate 18*b*, a third gate 18*c* and a fourth gate 18*d*. The direction of the electrical field E, thus the polarization direction, is illustrated at the first gate 18*a* and at the fourth gate 18*d*, in each case, by an arrow 20. The first gate 18*a* and the fourth gate 18*d* are the connector gates, which, such as known per se in the case of such diplexers, are connected by means of hollow conductor(-sections) (not shown) with a transmitter and a receiver.

Figure 2:
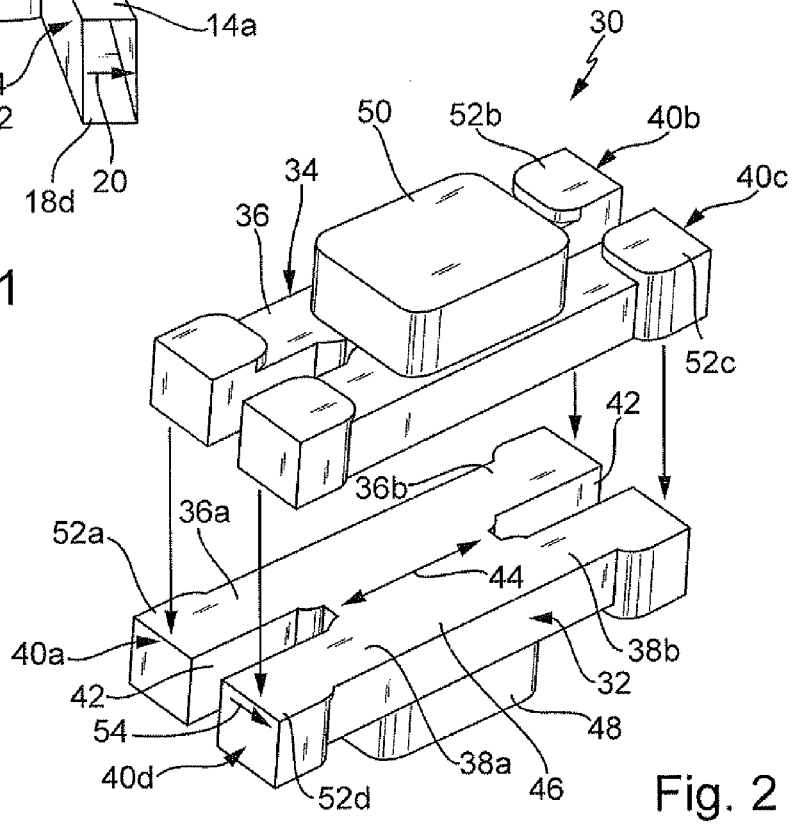
FIG. 2 is a perspective representation of an example of an embodiment of the diplexer of the invention.

FIG. 2 is a perspective representation of an example of an embodiment of the diplexer 30 of the invention in the form of two symmetric half shells 32 and 34. Preferably, in the case of the diplexer of the invention 30, a separation-, or cutting plane of the half shells 32 and 34 is the plane of the electrical field E, which is indicated in FIG. 2 by an arrow referenced with "54". For drawing related reasons the per se hollow structures in FIG. 2 are presented in gray, and are, in each case, introduced in a surrounding block of suitable material, preferably milled in, so that, in this way, the symmetric half shells 32 and 34 are created.

As FIG. 2 illustrates, two closely adjoining, parallel, hollow conductor channels 36 and 38 with preferably rectangular cross section and horizontal polarization are separated by a partition 42, so that terminally on the hollow conductor sections 36*a*, 36*b* and 38*a*, 38*b* a first gate 40*a*, a second gate 40*b*, a third gate 40*c* and a fourth gate 40*d* are formed. Partition 42 is interrupted by an opening 44, in order to provide a coupling zone 46 between the hollow conductor channels 36 and 38. Since the desired broadband behavior of the diplexer 30 of the invention is obtained only in the case of a certain ratio of hollow conductor dimensions to the dimensions of the coupling zone 46 and the depressions 48, 50, the hollow conductor dimensions are not arbitrarily selectable. More exact explanations of these conditions are given below in connection with FIG. 4. In order to move from the resulting hollow conductor dimensions to the system-predetermined, hollow conductor cross sections for connection with transmitters and receivers, transitions 52*a*-52*d* are introduced at each hollow conductor gate 40*a*-40*d*. Transitions 52*a*-52*d* which are so embodied in position and shape that they support the desired broadband behavior of the diplexer 30.

Figure 3:
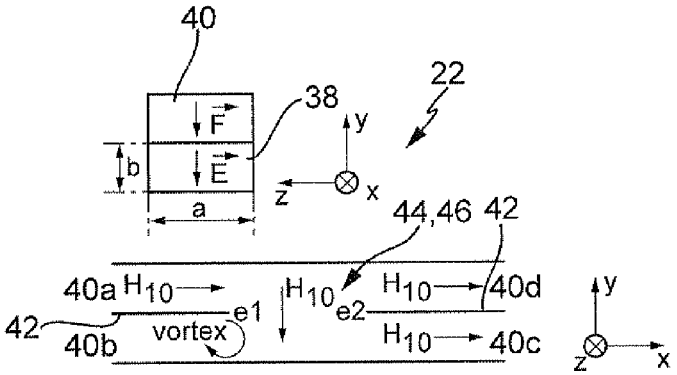
FIG. 3 is a sketch of the principles of an idealized diplexer of the invention.

The principles of operation of the structure illustrated in FIG. 2 of a slit coupler in the plane of the electrical field E 54 is illustrated schematically in FIG. 3. For explanation, reference is also made to FIG. 2.

The hollow conductor channels 36, 38 separated per se by an ideally "infinitely" thin partition 42 are connected in the coupling zone 46 by means of the opening 44. In the coupling zone 46, H10 mode waves can propagate both in the y- as well as also in the x direction. An edge e1 in FIG. 3 forms for the field of an H10 mode wave coming from the first gate 38*a* a strong disturbance location, which leads to a vortex of the E-field in the coupling zone 46 before the second gate 40*b*. By a combination of different frequencies with different dimensions of the coupling zone 46, the vortex can prevent the propagation of the H10 mode wave into the second gate 40*b*, since thereby also possible returning waves excited by an additional edge e2 at the other end of the coupling zone 46 can be prevented. This behavior holds, however, only for narrowband applications. Moreover, it is, because of the few degrees of freedom in the design of the diplexer 30, extraordinarily difficult to achieve a symmetric (−3 dB) coupling to the output gates 40*c* and 40*d*.

The upper part of the representation in FIG. 3 illustrates the coupling zone 46 (see FIG. 2) in the z-direction.

Another problem of the above described, ideal, slit coupler is its practical execution and implementation, since such a coupler in a practical embodiment always has a finite thickness of the partition 42 (see FIG. 2). The thicker the partition 42, the easier the diplexer is to manufacture, however, the more it deviates from the ideal, above described operation.

In order, however, to lessen the problems with the finite thickness of the partition 42 (see FIG. 2) and the therewith arising problems with additional edges in the coupling zone 46, the invention provides the construction of the diplexer 30 illustrated in FIG. 2 from the two half shells 34, 36 joined together in the E-plane. By following the below described, mutually matched ratios of the hollow conductor structure, it is possible, in simple manner, to provide a diplexer for broadband applications. In this regard, a plurality of hollow conductor modes are utilized, in order to achieve broadband behavior of the diplexer 30. New, above all, in the case of couplers of this type is the unusual exciting of the H20 mode by exactly defined edges, disturbance locations and especially by depressions in the shared coupling zone 46. Each of the disturbance locations excites non-propagation capable, decaying waves, which act as energy storers and for implementing the electrical properties are set in a certain relationship to one another. The latter is ascertained by targeted variation of the disturbance location parameters by means of per se known programs for three dimensional, full wave analysis of such a diplexer.

As already mentioned above, the coupling zone lies in the z-direction referenced in FIG. 3, so that both H20 mode—as well as also H01 mode waves are excited. How this can be utilized in a controlled manner will be explained based on parameters of the structure illustrated in FIG. 4 of a special form of embodiment of the diplexer 30 of the invention.

In a height ak of the coupling zone 46 (see FIG. 2) extending in the z-direction (compare FIG. 3), H20-, H01- and H10 mode waves have different propagation velocities, which lead to shared interferences, which influence the site for the vortex (see vortex in FIG. 3). A optimizing of the height ak of the coupling zone 46 permits placing the vortex of the E-field in front of the fourth gate 40*d* and so to achieve the desired behavior. Further optimizing can be achieved by reducing the widths bk and the lengths lk in the z-direction of the depressions 48, 50 (see FIG. 2) as well as by adapting the transition zones lp, by of the partition 42 into the coupling zone 46.

Figure 4:
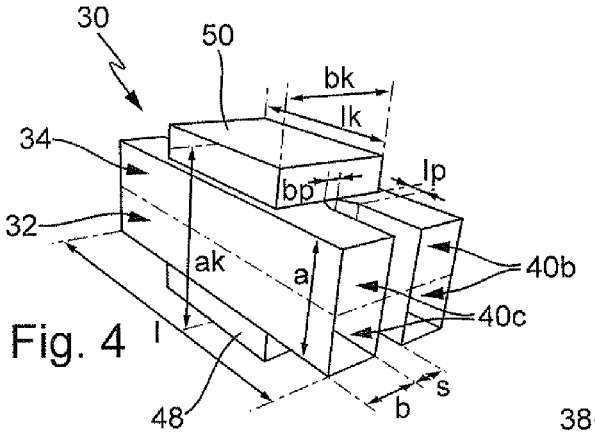
FIG. 4 is a sketch of the principles of a structure of the diplexer of the invention with parameters.

In the following, parameters are given based on FIG. 4 for a practical example of an embodiment of the diplexer 30 of the invention for 70 GHz-85 GHz:

| parameters (per FIG. 4) | dimensions in mm |
|---|---|
| a | 3.1 |
| b | 1.3 |
| s | 0.8 |
| l | 7.0 |
| ak | 5.56 |
| bk | 3.04 |
| lk | 3.94 |
| bp | 0.4 |
| lp | 0.5 |

In this way, a diplexer is achieved, which is distinguished by almost symmetric power distribution and good isolation in the case of good matching at the gates over a bandwidth of, for instance, 20%.

The special manufacturing friendliness of the diplexer 30 of the invention results from implementation using two symmetric half shells, which—relative to the wavelength of the wanted frequency—can be manufactured compactly. It has been found that, in the case of application of aluminum, injection molded, half shells, the overall shape of the structure can be so designed that it can be manufactured with a small milling tool diameter, for example, in the order of magnitude of 1 mm. In this way, a short working time and a relatively high precision are obtained.

Figure 6:
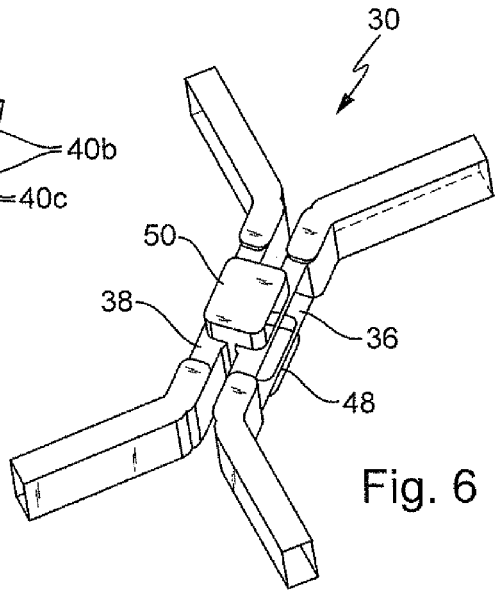
FIG. 6 is a perspective representation of a practical example of an embodiment of the diplexer of the invention.
Figure 5:
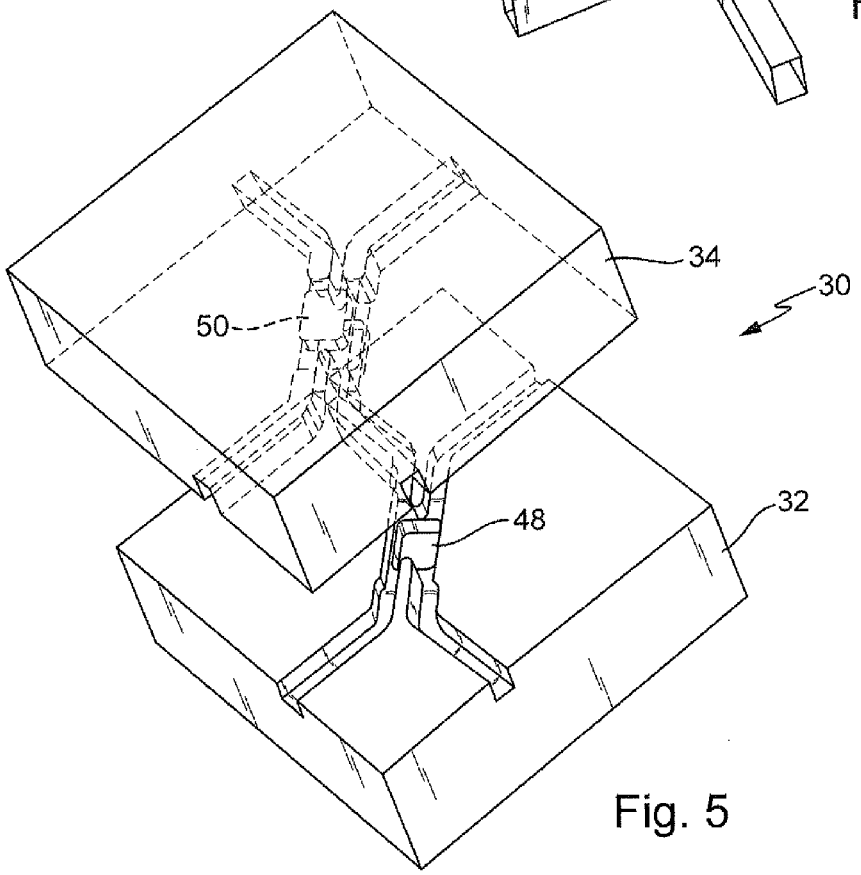
FIG. 5 shows two half shells of the diplexer of FIG. 3 with milled in structure.

FIGS. 5 and 6 show in the form of perspective representations the structure of a practical example of an embodiment of the diplexer 30 of the invention. While FIG. 5 illustrates the individual structures cut into a block for each half shell, FIG. 6 shows, in enlarged scale, the structures cut out from the blocks of the half shells joined together for the diplexer 30.

Other injection molding materials than the above mentioned aluminum provide options for the half shells of the diplexer 30, such as, for example, synthetic material, e.g. plastics. Likewise providing options are other shapes for the depressions 48, 50 (see FIG. 2) than those illustrated in FIGS. 2 and 4, such as e.g. rectangular or cylindrical depressions.

The diplexer of the invention is suited especially for application in a fill level measuring device operating with radar signals.

The invention claimed is:

1. A diplexer for a homodyne FMCW radar device, said diplexer being manufactured from two symmetric half shells, comprising:

two closely adjoining, parallel, hollow conductor channels having horizontal polarization, said polarization being the direction of electrical field strength, wherein the cutting plane of said half shells is the plane of the electrical field strength E, and terminal hollow conductor gates;

a coupling zone in an opening in a partition for connecting said hollow conductor channels; and depressions located in the region of said coupling zone and arranged perpendicular to said hollow conductor channels, wherein:

a ratio of the dimensions of said hollow conductors channels to the dimensions of said coupling zone and said depressions is so selected that the diplexer displays a broadband behavior and enables propagation of an H20 wave in said coupling zone; and at said terminal hollow conductor gates there are located transitions to the transmitter and receiver connected to the diplexer provided, which transitions are so embodied in position and form that they support the desired broadband behavior.

2. The diplexer as claimed in claim 1, wherein:

said terminal hollow conductor channels have a rectangular cross section.

3. The diplexer as claimed in claim 1, wherein:

said depressions are embodied approximately prismatically.

4. The diplexer as claimed in claim 1, wherein:

said depressions are embodied cylindrically.

5. The diplexer as claimed in claim 1, which is composed of two half shells, wherein:

said terminal hollow conductor channels, said depressions and said transitions are milled from said half shells.

6. The diplexer as claimed in claim 5, wherein:

the milling is done with a tool having a diameter of, for instance, 1 mm.

7. The diplexer as claimed in claim 1, which is assemblable from two half shells, which are injection molded parts.

8. The diplexer as claimed in claim 7, wherein:

said half shells are plastic injection molded parts.

9. A fill level measuring device, comprising a diplexer having a diplexer for a homodyne FMCW radar device, comprising:

two closely adjoining, parallel, hollow conductor channels having horizontal polarization and terminal hollow conductor gates;

a coupling zone in an opening in a partition for connecting said hollow conductor channels; and depressions located in the region of said coupling zone and arranged perpendicular to said hollow conductor channels, wherein:

a ratio of the dimensions of said hollow conductors channels to the dimensions of said coupling zone and said depressions is so selected that the diplexer displays a broadband behavior and enables propagation of an H20 wave in said coupling zone;

at said terminal hollow conductor gates have transitions to the transmitter and receiver connected to the diplexer provided, which transitions are so embodied in position and form that they support the desired broadband behavior; and the diplexer is manufactured from two symmetric half shells.

* * * * *